United States Patent [19]

Pirotte

[11] 4,016,646

[45] Apr. 12, 1977

[54] METHOD OF MAKING A RESISTOR

[75] Inventor: Franz Lucien Ghislain Pirotte, Brussels, Belgium

[73] Assignee: U.S. Philips Corporation, New York, N.Y.

[22] Filed: Nov. 20, 1975

[21] Appl. No.: 633,577

[30] Foreign Application Priority Data

Dec. 16, 1974 Netherlands ..... 7416327

[52] U.S. Cl. ..... 29/613; 29/610 R; 29/447; 338/328; 338/322; 338/332

[51] Int. Cl.[2] ..... H01C 17/02

[58] Field of Search ..... 338/328, 269, 275, 322, 338/324, 327, 330, 332; 29/619, 610, 613, 621, 447

[56] References Cited

UNITED STATES PATENTS

| | | | |
|---|---|---|---|
| 2,489,409 | 11/1949 | Green et al. | 29/619 X |
| 2,698,372 | 12/1954 | Patla | 29/619 X |
| 3,021,589 | 2/1962 | Weller | 29/619 X |
| 3,820,239 | 6/1974 | Nagata | 29/619 |

*Primary Examiner*—C. L. Albritton
*Attorney, Agent, or Firm*—Frank R. Trifari; Daniel R. McGlynn

[57] ABSTRACT

A method of making electrical resistors, in particular N.T.C. resistors for high temperature applications. The body of resistance material is provided with electrodes; and the ends of the leads are clamped against the electrodes in a case consisting of ceramic material which shrinks during sintering.

6 Claims, 8 Drawing Figures

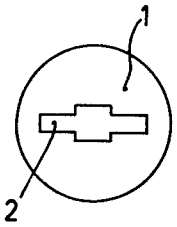
Fig.1
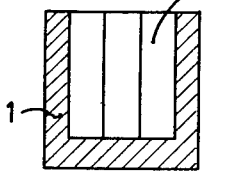
Fig.2
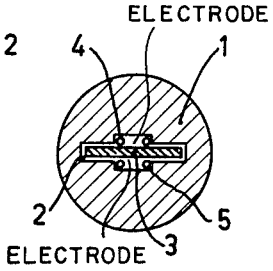
Fig.3
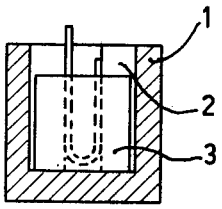
Fig.4
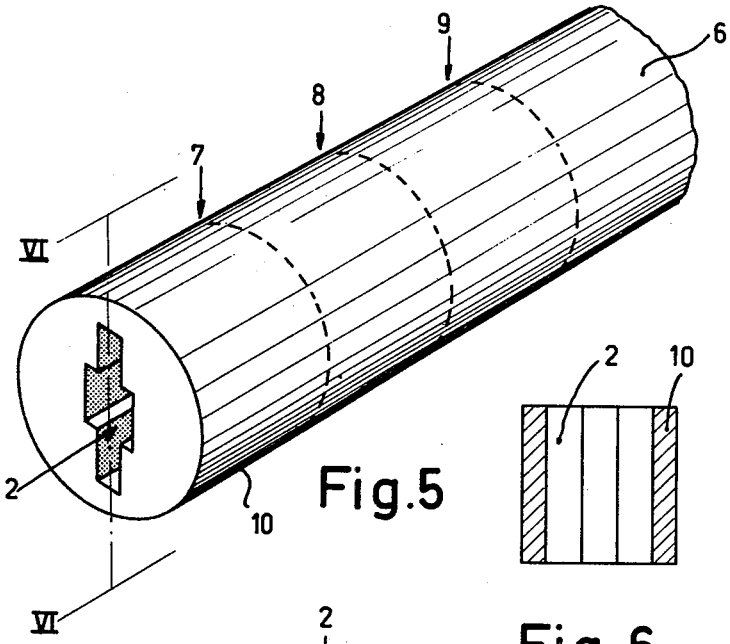
Fig.5
Fig.6
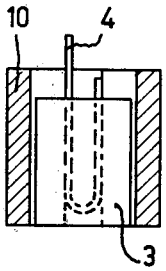
Fig.7
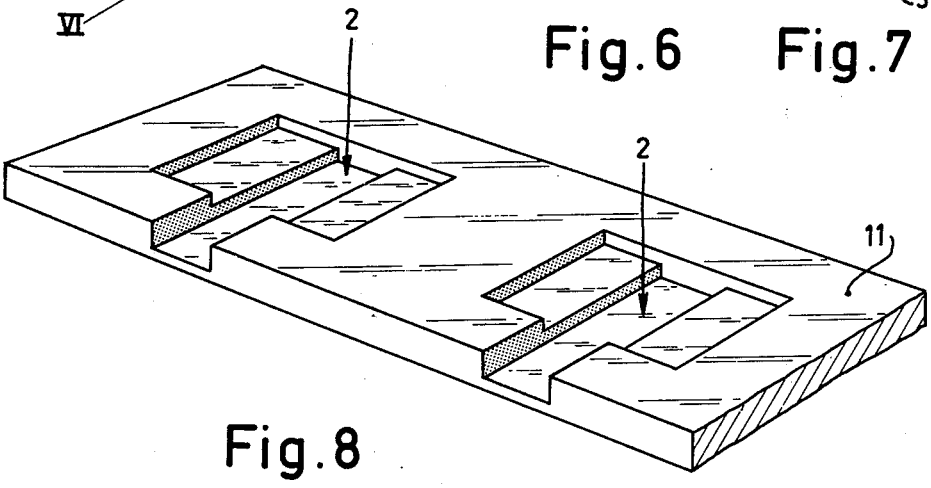
Fig.8

METHOD OF MAKING A RESISTOR

The invention relates to an electric resistor, comprising a body consisting of resistance material provided with electrodes, leads, whose ends are clamped against the electrodes and means for clamping the ends of the leads against the electrodes. The invention also relates to a method of manufacturing such a resistor. A resistor is known for which the means for pressing the bent ends of the leads against the electrodes on the body of resistance material consists of a box-shaped envelope of synthetic material in which the bent and resilient ends of the leads against the electrodes are enclosed. This resistor apparently cannot be used for temperatures above approximately 150 ° C.

In the art there is a need for resistors which can be used at high temperatures, for example to 1000° C. In this connection electronic temperature control using N.T.C. resistors could be mentioned as an example.

With such resistors difficulties are encountered when connecting the leads to the electrodes on the body of resistance materials. In general hard solders are less suitable for this purpose as they are as a rule difficult to process. For ultrasonic welding it is imparative that the body of resistance material is very flat at the jointing place. In general the desired flatness can only be obtained at the cost of great efforts and in a number of cases only in a complicated manner due to reasons of a technological nature. For the production of miniature resistors a method is customary in which drops of ceramic suspension are applied on two thin parallel metal wires, whereafter they are sintered at a high temperature. The resistors obtained in this way can be sealed into glass after having been separated from one another. A disadvantage of this construction is the poorly defined dimensions of the ceramic body, which causes a large spread in the resistance values. For these values close tolerances can therefore only be realized at the expense of a large amount of rejects.

An object of the invention is to provide an electric resistor and a procedure for manufacturing such a resistor which is suitable for use at a high temperature while the trouble which may occur with the known constructions are avoided as much as possible. According to the invention this object is fulfilled by an electric resistor which is characterized in that the ends of the leads are clamped against the electrodes by a casing consisting of sintered, electrically non-conducting material, which at least partly envelopes the ends of the leads lying against the electrodes and the body consisting of resistance material.

The body consisting of resistance material may, for example, be plate or disk-shaped or have another suitable shape, for example the shape of a cylinder or bar.

The leads may consist of wires whose end which is to be clamped against the electrodes may, for example, be bent, for example to a U-shape, to provide a larger area of contact with the electrodes. The leads may also consist of metal strips or tapes. As usual the electrodes consist of thin metal layers. An electric resistor according to the invention can be obtained by enveloping the body consisting of resistance material together with the ends of the leads contacting the electrodes with a formed mass of electrically non-conducting material which shrinks during sintering and by sintering this mass.

The mass consisting of electrically non-conducting material must envelope at least such a part of the body consisting of resistance material that at sintering of the mass and shrinkage thereof the ends of the leads are clamped against the electrodes on the body consisting of resistance material. The mass consisting of electrically non-conducting material may be formed during application round the body consisting of resistance material. To this end the body consisting of resistance material can be placed in a form, the ends of the leads lying against the electrodes. Thereafter the form is filled under pressure with the mass consisting of electrically non-conducting material.

It is also possible to form the mass consisting of electrically non-conducting material beforehand while providing it with suitable cavities to accommodate the bodies consisting of resistance material and the ends of the leads. For example, individual casings can be pressed provided with a cavity to accommodate the body consisting of resistance materials and the ends of the leads. It is also possible to extrude continuously a tube provided with a continuous axial cavity of such a form that after dividing the tube in pieces of a suitable length, a body consisting of resistance material and the ends of the leads can be placed in the cavity in such a piece.

It is also possible to extrude strips from a mass consisting of electrically non-conducting material and to provide these strips with cavities of a suitable form, for example by means of a contoured roller. After the bodies consisting of resistance material and the ends of the leads are placed in the cavities, the assembly is covered with a strip from the mass consisting of electrically non-conducting material. If necessary the second strip may have been provided with corresponding cavities which, together with the cavities in the first said strip, offer, in pairs, each time sufficient room to accommodate the body consisting of resistance material and the ends of the leads. Hereafter the strips, which may have, if so desired, been divided in lengths which each contain at least a body consisting of resistance material, are sintered. It is also possible to sinter strips in which a number of bodies consisting of resistance material are enclosed and to divide the strips after sintering in lengths which each contain at least a body consisting of resistance material, for example by means of sawing.

Masses consisting of electrically non-conducting material which appeared suitable for the objects of the invention, have a linear shrinkage of 10% or more during sintering. In certain circumstances however, also a smaller shrinkage may sometimes have the desired results. It is clear that for different fields of application with other maximum operating temperatures materials should be chosen which as regards the shrinkage during sintering, the coefficient of expansion, sintering temperature and temperature resistance answer the purpose.

Masses of electrically non-conducting material may, for example, be composed of mixtures of finely ground glass and clay, optionally with the addition of aluminium oxide, for example by mixing equal quantities of each of the said components while adding a suspension or solution of a binder such as for example polyvinylacetate, polyvinylalcohol, polyoxyethylene.

A mass which proved to be particularly suitable in practice is obtained by melting a mixture of aluminium oxide, boron oxide and potassium oxide, by pulverising the mass thus obtained after cooling and by mixing it with a solution of a suitable binder.

Suitable masses having a shrinkage of approximately 10% when sintered between approximately 650° and approximately 800° C contain 10–50% by weight of $Al_2O_3$, 60 to 20% by weight of $B_2O_3$ and 45 to 20% by weight of CaO. The mixtures are premolten at temperatures between approximately 1000 and approximately 1500° C, and pulverized after cooling. The powder obtained is mixed with a solution of a binder such as polyvinylacetate until a pressable or extrudable mass has been obtained.

An embodiment of an electric resistor according to the invention will be further explained with reference to the drawing.

FIG. 1 shows a top view of a casing consisting of a ceramic material;

FIG. 2 shows a cross-section of the casing in side view;

FIG. 3 shows a cross-section of the casing in top view, the body consisting of resistance material and the leads having been placed therein;

FIG. 4 shows a cross-section in side view of the electrical resistor;

FIG. 5 shows in perspective a hollow extruded tube,

FIG. 6 shows a cross-section of a part of a tube according to FIG. 5;

FIG. 7 shows the same cross-section as FIG. 6 with inserted resistance body and one of the leads;

FIG. 8 shows a part of an extruded and subsequently rolled strip having cavities to accommodate a resistance body. In the example shown in the figures the resistance body is a plate consisting of resistance material. To this end the cavity 2 in casing 1 has, when viewed from the top, the shape of a cross. The body 3 consisting of resistance material provided with electrodes, consisting of thin metal layers, for example of silver on two opposite faces is placed in the long arms of the cross 2. The leads 4 and 5 whose end has been bent to an U-shape are placed in the short arm of the cross 2, at either side of the plate-shaped body 3 consisting of resistance material. Thereafter the assembly is heated in a furnace to effect sintering of the material casing 1 consists of. During sintering shrinkage occurs, which produces a pressure contact between the ends of the leads 4 and 5 and the electrodes on the body 3 consisting of resistance material. In a practical embodiment body 3 consisted of a square plate (side 2 mm, thickness 0.5 mm) of a material having a negative temperature coefficient of the resistance, comprising NiO and $Fe_2O_3$, which material was sintered at 1300° C. The electrodes consisted of a thin silver layer obtained in known manner by applying a silver paste on the opposite faces of the body 3 and subsequent heating to 750° C. The leads consisted in a number of cases of silver (diameter 0.4 mm), in other cases of silverplated nickel (diameter 0.4 mm). The casing consisted of a mixture of 20% by weight of $Al_2O_3$, 24% by weight of CaO and 56% by weight of $B_2O_3$ with a binder of polyvinylacetate which was added in the form of a methylethylketone solution (90 g of PVA per litre of M.E.K.) in a quantity of 400 ml per kg of the powdered mixture. The casing 1 in which the body 3 consisting of resistance material and the ends of the leads were enclosed were sintered at 700°C. This resulted in a linear shrinkage of approximately 10%. The N.T.C. resistors obtained in this way behaved a favorably result during the following temperature cycling test.

After 4000 cycles of 40° to 350° C and back (8 cycles per hour) no change in the resistance value of the resistor or in another way of the mechanical quality of the contacts was found. This same result was obtained at continuous heating during 200 hours at 500° C.

The invention offers the advantage that by means of a number of simple operations which if desired can be readily mechanized, good electrical contacts can be obtained which will resist high temperatures, while no soldering, welding or cementing is required.

Casings consisting of electrically non-conducting material, which shrink during sintering, while clamping the ends of leads against the electrodes on a resistance body applied therein can also be obtained by extruding a tube having a suitably shaped cavity. FIG. 5 shows in perspective a part of such a tube. After extrusion the tube is divided in pieces of the desired length, for example according to the dashed lines 7, 8 and 9. FIG. 6 shows a cross section VI—VI of FIG. 5. The cavity 2 in the tube part 10 is suitable for receiving a plate-shaped resistance body 3 with lead ends, one of which (4) is shown in FIG. 7. FIG. 8 shows a part of an extruded strip 11, in which cavities 2 have been applied by means of rolling, which cavities are suitable to receive resistance bodies with leads. After they have been applied an identical strip is placed on strip 11 in such a way that the cavities coincide. During sintering which, if desired, may be done under pressure the strips are sintered together. After sintering, by means of sawing, the strips can be divided in pieces which each contain a resistance body. It will be clear that the cavity 2 may have any shape which is suitable to accommodate a resistance body with the ends of the leads. When tape-shaped leads are used the short arms of the cross-shaped opening may, for example, be less deep as shown in the FIGS. 1, 5 and 8 or in certain circumstances they may be entirely absent, if the thickness of the resistance body is sufficiently smaller than the width of the opening.

What is claimed is:

1. A method of manufacturing an electrical resistor comprising the steps of providing a body of resistance material having electrodes;

providing leads having ends clamped against said electrodes;

enveloping said body together with said ends of said leads with a formed mass of electrically non-conducting material which shrinks during sintering; and sintering said mass.

2. A method as claimed in claim 1, further comprising the step of placing said body consisting of resistance material with the ends of the leads lying against the electrodes in a form filled under pressure with said mass of electrically non-conducting material which shrinks during sintering.

3. A method as claimed in claim 1, wherein said electrically non-conducting mass has a linear shrinkage of 10% or more during sintering.

4. A method as claimed in claim 1, further comprising the step of placing said body consisting of resistance material with the ends of the leads lying against the electrodes in a preformed mass of electrically non-conducting material which shrinks during sintering.

5. A method as claimed in claim 4, further comprising the steps of forming a tube of electrically non-conducting material provided with a suitable formed axial cavity said tube being divided into parts; and placing said resistance body with the ends of the leads lying against the electrodes in each of said parts.

6. A method as claimed in claim 4, further comprising the steps of forming a strip of electrically non-conducting material provided with cavities to accommodate resistance bodies with the ends of the leads against the electrodes, said cavities being covered with said formed mass of electrically non-conducting material.

* * * * *